United States Patent [19]

Poletto

[11] Patent Number: 4,941,886

[45] Date of Patent: Jul. 17, 1990

[54] PROCESS FOR OBTAINING A SYNTHETIC CHAMOIS LEATHER SIMILAR TO NATURAL CHAMOIS

[75] Inventor: Giorgio Poletto, Ciríe, Italy

[73] Assignee: Lorica S.P.A., Corso Lombardia, Italy

[21] Appl. No.: 208,059

[22] Filed: Jun. 16, 1988

[30] Foreign Application Priority Data

Jun. 19, 1987 [IT] Italy ..... 67534 A/87

[51] Int. Cl.[5] ..... D06P 7/00

[52] U.S. Cl. ..... 8/497; 8/637.1; 8/674

[58] Field of Search ..... 8/497, 637, 674; 521/918; 427/389.9, 389.8, 245, 247, 223; 156/153, 254, 344

[56] References Cited

U.S. PATENT DOCUMENTS 3,284,274 11/1966 Hulslander et al. ..... 156/153
3,616,023 10/1968 Fukushima et al. ..... 156/254
3,876,491 4/1975 Martel ..... 156/344
3,906,131 9/1975 Boe ..... 427/245

*Primary Examiner*—Paul Lieberman
*Assistant Examiner*—John F. McNally
*Attorney, Agent, or Firm*—Michael N. Meller

[57] ABSTRACT

A process is described which permits synthetic chamois pelts entirely similar to natural pelts to be obtained; the process consists in starting from any known synthetic sheet material of the type formed by a porous polyurethane matrix having synthetic fibres embedded therein and a covering skin layer of compact polyurethane resin applied to one face of the matrix, and in splitting it into two layers, a first identical to the starting material, that is provided with the matrix and the covering layer, but thinner, and a second composed only of the matrix, and in then subjecting this latter, after buffing, to a dyeing operation performed with textile technology, followed by a folding phase also typical of textile treatment, and by possible stamping and re-buffing phases.

11 Claims, No Drawings

PROCESS FOR OBTAINING A SYNTHETIC CHAMOIS LEATHER SIMILAR TO NATURAL CHAMOIS

BACKGROUND OF THE INVENTION

The present invention relates to a process which permits a synthetic oil tanned or chamois pelt to be obtained entirely similar to natural pelt of this type but starting from a known synthetic sheet material having the characteristic of comprising a porous polyurethane matrix with synthetic fibres embedded therein and having a covering skin of compact polyurethane resin secured to one face of the matrix.

It is known that natural chamois pelts are obtained by buffing, after tanning, the rear part of the natural pelts, or rather that part opposite the skin, which is found, on the animal, in contact with the meat, and/or the part immediately underlying the epidermis itself before removal of this latter with splitting operations subsequent to a treatment with sodium sulphide which has the purpose of removing the hairs. The particular characteristics of chamois leathers, together with their characteristic aspect and "handle" (with this termis indicated the tactile sensation which a person experiences in touching the pelts) are in large measure due to the orientating effect which the buffering phase has on the collagen fibres, which constitute the major part of the corium of which chamois leathers are formed. For the purpose of producing imitations of natural chamois leathers several materials have been produced which are able to be subjected to a buffering phase similar to that to which natural pelts are subjected; such materials seek to imitate the structure of the corium of the animal pelts (by corium is meant the layer of a pelt immediately underlying the epidermis) and for this reason comprise a more or less compact matrix in which are embedded, or between which are inserted, artificial fibres; in one known product currently in commercial use under the name ALCANTARA (registered trade mark) the matrix is made of polyurethane into which microspun polyester fibres are incorporated with special techniques. However, with the known materials and techniques a product of quality similar to that of natural chamois pelts is not successfully obtained; not even ALCANTARA, in fact, whilst being one of the most valued artificial materials, has a handle equivalent to that of natural chamois pelts, so that its use is limited in clothing and furnishings.

SUMMARY OF THE INVENTION

The object of the invention is that of providing a process by means of which any synthetic sheet material, provided that it has certain starting characteristics, can be transformed in a simple and economic manner into an imitation of natural chamois pelts suitable, because of its characteristics, to be used in substantially all the fields in which natural chamois pelts are applicable.

The said object is achieved by the invention, which relates to a process for obtaining a synthetic suede chamois, characterised by the fact that a synthetic sheet material of predetermined thickness, which comprises a porous polyurethane matrix in which is embedded a fibrous reinforcement formed by non-woven fabric and/or fibres chosen from the group comprising polyester fibres, polyamide fibres and polyethylene fibres, and a covering layer of compact polyurethane resin formed securely on one face of the said porous matrix, is split in correspondence with the said matrix into two sheets of reduced thickness, a first of which comprises the said covering layer provided securely with an underlying first portion of the said matrix, and a second of which is formed solely by a second portion of the said matrix, in such a way as to cut the said fibrous reinforcement and subdivide it between the said first and second portion of the matrix; the said second sheet being subsequently subjected to a buffing phase of the type normally used for natural chamois leathers, and to a dyeing phase.

DETAILED DESCRIPTION OF THE INVENTION

In substance, the applicant has surprisingly discovered, after years of experiment, that to successively obtain a better imitation of chamois pelts utilising as the first material for the buffing, rather than a synthetic material prepared chemically ad hoc directly in imitation of the animal corium, a sheet portion of a synthetic sheet material obtained by means of a mechanical splitting operation (or rather subdivision of the starting sheet material into two sheets of smaller thickness) similar to that which natural pelts are subjected to obtain the chamois version; this operation permits the desired results to be obtained, or in any case improves the results only and exclusively if the starting material which is separated into two sheets has a structure in imitation of that of the animal pelt, that is if this material comprises a porous matrix, preferably composed of expanded and/or chemically coagulated polyurethane in which are embedded synthetic fibres, in imitation of the corium, and a surface skin, securely formed on one face of the matrix, composed of a layer of compact resin, for example polyurethane, possibly stamped in imitation of the animal epidermis. During this splitting operation, which is performed on machines utilised for this purpose on natural pelts, the material of the matrix, probably by the effect of the presence of the compact skin, splits in such a way as to produce a particular cut in the fibrous reinforcement composed of the fibres embedded in the matrix and its subdivision between the two sheet portions into which the matrix itself is subdivided; obviously one of these portions has a structure similar to that of the starting material even if, obviously, of smaller thickness, in that it will be composed of the compact surface skin and by the underlying portion of matrix and fibre remaining attached to it, whilst the other portion of the matrix gives a sheet of new material, of smaller thickness (identical to the reduction in thickness of the starting material), solely composed of the porous polyurethane matrix portion and a part of the fibrous reinforcement contained in it and split off from the starting material; according to the invention it is this sheet of new material, thus obtained, which is then subjected in a known way to the known buffing operation and to a dyeing phase to impart the desired colour, surprisingly giving at the end of the process a synthetic suede of very much better quality than that of currently known synthetic products on the market and distinctly better than that obtainable with any other material having initially only a matrix provided with a fibrous reinforcement embedded in it and treated in the same way. It is emphasised that this result is entirely unexpected in that there is apparently no reason to obtain better results by working a material structurally identical to those already utilised for synthetic suede (or rather composed of a matrix with embedded fibres) and having the single difference, with respect to these, of having been obtained by mechanical subdivision from a sheet of greater thickness and mixed structure, rather than coming directly prepared at the desired thickness and fibrous structure during the construction stage. According to the invention the improved results are obtained utilising as the starting material a raw synthetic leather produced by KURARAY CO LTD composed of a matrix of coagulated porous polyurethane provided internally with a plurality of polyamide (NYLON) fibres embedded in it in such a way as to be free to slip along their axes, and by a covering skin made of compact polyurethane fixed securely onto one face of the matrix and embossed in imitation of the typical configuration of the grain of any natural pelt. Still according to the invention, after the splitting phase the first, upper sheet of material which is obtained, that is to say that composed of the matrix portion remaining attached to the covering skin and by this latter, can be worked according to the process described in Italian Patent application No. 67585-A/84 filed June 6, 1984, obtaining a synthetic leather of excellent quality and entirely similar to natural leather, whilst the second, lower sheet, composed solely of the matrix portion separated from the starting material, is buffed on both its opposite faces by means of three passages between two rotating cylinders externally clad with glass paper, two for the upper face and one for the lower face.

Subsequently this sheet of buffed material is dyed, utilising according to the invention textile technology, or rather technology which no tanning expert or organic chemist who desired to imitate a pelt at the end of working would consider applying to such material. The sheet or sheets obtained with the splitting operation and the subsequent buffing are formed into a loop, for example by sewing together the opposite ends thereof, and are then introduced into a textile dyeing machine of the "jet" or "flow" type; these known machines are used for washing and dyeing textile fabrics, and are also commonly called "fullers", and essentially comprise a closed container provided with a lower basin and various facing annular ducts in which textile fabric loops recirculate, which ducts are connected to the basin and provided with nozzles for the introduction of water, air and washing solutions, which can collect again in the basin from which they are recirculated by pumps; in such a dyeing machine the strips of split and buffed raw material are introduced in place of the textile fabric strips and recirculated by the action of suitable rollers. After the dyeing phase, and still wet, these strips of material are subjected, according to a further detail of the invention, to a folding and foulard treatment entirely identical to that commonly performed on textiles, and also utilised in the process of the invention going against common logic, and are subsequently dried with air. The known folding phase consists in unrolling the treated material collected in a roll and in collecting it in a continuous manner folded on itself in alternately opposite directions. Before drying, each sheet of treated material is subjected to a fireproofing stage according to Italian Patent application No. 67584-A/84 of June 6, 1984 the contents of which are incorporated here for the necessary parts, consisting in treating the sheets first with an aqueous solution of from 24 to 60% by weight of a mixture of fireproofing material based on ammonium phosphate, guanidine and/or pentaerythritol, and subsequently with an aqeous solution of from 8 to 20% by weight of the same mixture of fireproofing substances previously used and from 8 to 20% by weight of a softening substance containing compounds having linear hydrocarbon chains from 12–18 atoms of carbon coupled to radicals of the type $—SO_3X$, where X is an alkaline metal or $—(OCH_2CH_2)_yOH$, where y is a whole number lying between (1 and 18). As an alternative to, or in combination with, this fireproofing phase each treated sheet is also subjected, before drying, or possibly even after, to a known waterproofing phase by immersion in a solution of polyfluorides. Finally the sheets thus treated are subjected to a known dry brushing or fulling of the same type as that used on natural chamois pelts, finally obtaining a synthetic suede unexpectedly entirely similar to natural pelt, in particular having a very similar handle to that of these latter. This final product moreover lends itself surprisingly to be stamped under pressure operating at a temperature greater than 90° C. and with the preliminary arrangement beneath the said second sheet of a felt, in the same way as that utilised in tanning technology, unlike other similar known products such as ALCANTARA (registered trade mark) which cannot be stamped in this way without damage. The sheets, when stamped, can also be newly surface buffed with a further passage between two rollers one of which is cladd with glass paper, or in a belt sander, in such a way as to grind the parts in relief of the previously stamped design, thus obtaining a final two-colour product (paler on the tips of the fibres holding upright by the previous stamping phase) similar to tapir skins.

In the majority of cases, when the final product is intended for normal uses, such as the manufacture of patches, working gloves, shoes etc, the dyeing phase is executed, according to the invention, by first treating the sheets of material with an ammoniacal azo-dye in such a way as to dye the matrix, and subsequently with at least one pre-metallised or metallic complex dye specific to the fibres contained in the matrix, for example for nylon fibres; to this end it is possible to use aniline and the dyes ISOLAN, TELON, LANACROM and ACIDOL (all registered trade marks); in the case of special uses, such as for clothing products the sheets are on the other hand dyed by treating them directly with a mixture of 5% by weight, based on the weight of raw material to be treated, of pre-metallised dyes (for example LANACROM) and with about 1% of ammonium sulphate, operating in an aqueous solution and at a temperature progressively increasing from 30° to about 110° C. For use in saddlery, on the other hand, dyes resistant to light are employed, utilising appropriate fixatives constituted by sulphuric acid mixed with aromatic groups having a high molecular weight and even utilising here dyes only specific to the fibres, in that the polyurethane matrix is also dyed thereby. A very good dye can be obtained also by utilising organic pigments precipitated with acetic acid.

The present invention will now be described with a series of non-limitative examples.

EXAMPLE 1

Twelve strips of raw sheet material of the type comprising a porous polyurethane matrix with embedded nylon fibres and an embossed covering skin of compact polyurethane, produced by KURARAY CO LTD, each of a length of about 10 meters and a thickness of 1.5 mm are longitudinally split with a blade into an upper sheet of a thickness of 0.8 mm constituted by part of the porous matrix of the starting material and the upper compact cladding layer thereof, and a lower sheet of 0.5 mm thickness, constituted by the matrix portion of the starting strips. The lower sheets are collected, passed 3 times through a belt sander at 40 meters/minutes with a speed of advance of 8 meters per minute and are then sewn into loops which are introduced, as were fabric loops, into two textile dyeing machines, some into a jet type and some into a flow type; into each of these machines there are introduced 500 liters of aqueous solution into which is dissolved aniline and ammonia at 24 Bé, respectively in the proportions of 3% and 5% by weight calculated on the weight of sheets being treated, the rotation of the loops of material being performed for 90 minutes; subsequently, washing water is introduced and then a 20% sulphurized whale oil stuffing emulsion, making the material rotate for 45 minutes; finally before washing with water again, a dye solution is introduced at 50° C., composed of a mixture in water of TELON A-3RL (registered trade mark), ISOLAN K-3GLS (registered trade mark) and TELON FRL (registered trade mark), respectively in the proportions 1.6%, 0.2% and 0.3% by weight of the weight of material to be dyed, with which the material is treated for 90 minutes. The treated and dried material is subdivided into lots, which are subjected to the action of different fireproofing/softening solutions indicated in table 1 and some of which are treated, by immersion, to the action of various solutions of 3–5% sodium polyfluoride and ammonium mixture. Finally some of the lots of material are dry brushed and some fulled and then some lots are stamped to impress on the sheets of treated material a design of parallel ribs by means of the application for 20 seconds, at 100° C., of a steel dye on each sheet, preliminarily positioning under these a felt of 4 mm thickness; some of the stamped sheets are subsequently buffed on the stamped surface upon a fresh passage through the said sanding machine. The characteristics of the various finally obtained products, compared with those of similar products in natural pelt and ALCANTARA (registered trade mark) are indicated in Table 3, whilst Table 2 provides decoding of the codes used in Table 3; in particular, the first column of Table 2 indicates the code which has then been indicated in Table 3, the second column indicates the fireproofing process used, by means of the numerical code (from 1 to 10) used in Table 1, the third column indicates, if employed, the percentage concentration of the waterproofing bath, column 4 has an S for brushing and an F for fulling to indicate the type of working after fireproofing, and an asterisk to indicate if the dyeing is executed in a flow type machine, column 5 has an S for stamped and a SS for stamped and re-buffed.

TABLE 2

| Working Code | Fireprofing Agent | Waterproofing % | Principal Washing | Subsequent Washing |
|---|---|---|---|---|
| A | 1 | — | F | — |
| B | 2 | — | S* | — |
| C | 3 | — | F | S |
| D | 4 | — | F* | SS |
| E | 5 | 5 | S | — |
| F | 6 | — | S | — |
| G | 7 | 2 | F* | S |
| H | 8 | 3 | F* | — |
| I | 9 | 4 | F | SS |
| L | 10 | — | F | — |

TABLE 3

| Sample | Working | Handle(*) | Waterproof | Combustion speed |
|---|---|---|---|---|
| 1 | A | B | No | Zero |
| 2 | B | O | No | " |
| 3 | C | B | No | " |
| 4 | D | O | No | " |
| 5 | E | B | Yes | " |
| 6 | F | O | No | " |
| 7 | G | O | Yes | " |
| 8 | H | B | Yes | " |
| 9 | I | O | Yes | " |
| 10 | L | O | No | " |
| Alcantara | — | D | — | — |
| Natural Pelt | — | E | Little | — |

(*)B = Good; E = Excellent; D = Fair; S = Poor

EXAMPLE 2

Twelve strips of the same material as used in example 1 each of 10 meters length and 1.8 mm thickness are treated operating as in example 1, deriving from them 12 sheets composed solely of porous polyurethane matrices with associated fibrous reinforcement, of thicknesses varying from 0.3 to 1.2 mm; these sheets are then worked as in example 1 but with a different type of dyeing; in particular, the sheets are dyed by introducing into the jet and flow machines 300% of their weight of water, 1% of their weight of ammonium sulphate, 1% of ALBEGAL SW (registered trade mark) a known fixer for pre-metallised dyes; after 15 minutes of rotation there is also introduced 5% by weight of the weight of products to be treated of a mixture of pre-metallised dyes (LANACROM and IRGALAN) and the temperature is progressively raised from 30° to 110° C. in 90 minutes. Results obtained are entirely similar to those of example 1 save for the fact that the handle of the final product is even better and the colouration is stable even on contact with human organic liquids such as sweat or the like so that the final product is considered excellent for articles of clothing and for furnishings.

EXAMPLE 3

Twelve strips of the raw material of example 1, each 10 meters in length and of 1.8 mm thickness are treated as in example 1, deriving from them 12 sheets composed solely of a porous polyurethane matrix with associated fibrous reinforcement with a thickness varying from 0.3 to 1.2 mm; these sheets are then worked as in example 1, but with a different type of dyeing; in particular, the sheets are dyed by introducing into the jet and flow machines, as a percentage of the weight of material to be treated, 300% of water, 3% of AVOLAN IW (registered trade mark), which is a dispersant for pre-metallised dyes based on alcohols and polyglycolethers, 10% of ASTRAGAL (registered trade mark), another known fixative for pre-metallised dyes, but based on cationic aral-aliphatic compounds of quaternary ammonium, and 5% of ISOLAN K-PRL (grey); the loops of material are made to rotate for 60 minutes raising the temperature from 30° to 90° C. and then washed with water at ambient temperature and a new charge of dye compound introduced composed of 300% water, 2% ISOLAN and 4% ASTRAGAL (percentages always refer to the weight of material to be treated) making the temperature rise from 30° to 96° in 50 minutes; finally, after a further washing, a third charge of dye compound is introduced composed of 300% water, 2% ISOLAN and 4% ASTRAGAL operating for 90 minutes with a temperature rising from 30° to 96° C.

EXAMPLE 4

Twelve strips of raw material as in example 1, each of 10 meters length and 1.8 mm thickness are treated operating as in example 1 deriving from them 12 sheets composed solely of a porous polyurethane matrix with associated fibrous reinforcement the thickness of which varies from 0.5 to 1.2 mm; these sheets are then worked as in example 1 but with a different type of dye; in particular, the sheets are dyed by introducing into the jet and flow machines, as a percentage of the weight of material to be treated, 200% of water at 30° C. and 30% of pigments; some of the 12 strips are treated with precipitated organic pigments obtained from dried and atomised lacquers and in particular the type commercially available under the name IRGAFIN (registered trade mark) whilst the remainder of the strips are treated with normal inorganic pigments (titanium dioxide and carbon black); the strips are worked for 60 minutes progressively raising the temperature up to 80° C.; then the solution is acidified up to a pH of 3.5 by adding acetic acid in such a way as to precipitate the pigments onto the material; then the temperature is lowered to 60° C. and a new dye charge is introduced onto the preceding one; charges constituted by the pre-metallised dye (TELON or ISOLAN) are used on 12 of the strips in various percentages from 0.1 to 4% added to 10% of ASTRAGAL and the temperature is raised to 110° C. in 90 minutes; finally the temperature is lowered to 60° C. and the last operation is repeated in an identical manner and with the same percentages of the various components of the charge, but operating in such a way as to reach 110° C. again in only 60 minutes; finally there is a washing process. The different forms of working are indicated in Table 4, together with the comparative valuations of the strength of the dye to light, evaluated in a known way on the BLU scale with values from 1 to 7; the strips worked as in example 3 and example 2 are also comparatively evaluated, and for each sample there is indicated a code in which the number refers to the number of the example and the letter to the type of working subjected according to table 2.

TABLE 4

| Sample Code | Dye (I = ISOLAN; T = TELON) I | T | % | Resistance | Pigment |
|---|---|---|---|---|---|
| 4-A | X | | 0.1 | 7 | Organic |
| 4-B | | X | 0.1 | | " |
| 4-C | X | | 0.5 | 7 | " |
| 4-D | X | | 1 | 7 | " |
| 4-E | X | | 4 | 7 | " |
| 4-F | | X | 4 | 7 | " |
| 4-G | X | | 2 | 7 | Titanium Dioxide |
| 4-H | | X | 2 | 7 | Carbon Black |
| 4-I | X | | 0.9 | 7 | " |
| 3-A | | | | 6 | |
| 3-B | | | | 6 | |
| 3-C | | | | 5 | |
| 3-D | | | | 6 | |
| 3-H | | | | 6 | |
| 2-A | | | | 3 | |
| 2-B | | | | 4 | |
| 2-C | | | | 5 | |
| 2-D | | | | 4 | |
| 2-H | | | | 4 | |
| Natural pelt | | | | 4 | |
| ALCANTARA | | | | 7 | |

TABLE 1

| No. | Fireproofing Agent | | Softening Agent | Fireproofing Solution % by weight: Fireproofing Agent | Fireproofing Solution % by weight: Water | Softening Solution % by weight: Softening Agent | Softening Solution % by weight: Fireproofing Agent | Softening Solution % by weight: Water |
|---|---|---|---|---|---|---|---|---|
| 1 | $(NH_4PO_3)_6$ | 310 gr | $C_{12}H_{25}OSO_3$ Na | 40 | As needed | 10 | 8 | As needed |
| | guanidine | 200 gr | | | | | | |
| 2 | $(NH_4PO_3)_6$ | 310 gr | | | | | | |
| | guanidine | 200 gr | $C_{18}H_{37}OSO_3$ Na | 50 | " | 15 | 15 | " |
| | pentaerythritol | 90 gr | | | | | | |
| 3 | $(NH_4)_5P_3O_{10}$ | 300 gr | | | | | | |
| | guanidine | 200 gr | $C_{16}H_{33}(OCH_2CH_2)_8OH$ | 35 | " | 10 | 10 | " |
| | pentaerythritol | 90 gr | | | | | | |
| 4 | $(NH_4)_5P_3O_{10}$ | 310 gr | | | | | | |
| | pentaerythritol | 90 gr | $C_{12}(OCH_2CH_2)_6OH$ | 55 | " | 18 | 17 | " |
| | $(NH_4PO_3)_6$ | 200 gr | | | | | | |
| 5 | $(NH_4)_5P_3O_{10}$ | 310 gr | | | | | | |
| | guanidine | 200 gr | $C_{16}H_{33}OSO_3$ Na | 48 | " | 15 | 15 | " |
| 6 | $(NH_4)_5P_3O_{10}$ | 310 gr | | | | | | |
| | guanidine | 200 gr | $C_{28}H_{37}OSO_3$ Na | 60 | " | 20 | 18 | " |
| | pentaerythritol | 90 gr | | | | | | |
| | chlorinated rubber | 3.5 gr | | | | | | |
| 7 | $(NH_4)_5P_3O_{10}$ | 310 gr | | | | | | |
| | guanidine | 200 gr | $C_{18}H_{37}(OCH_2CH_2)_{12}OH$ | 30 | " | 10 | 10 | " |
| | pentaerythritol | 90 gr | | | | | | |
| 8 | $(NH_4)_5P_3O_{10}$ | 310 gr | | | | | | |
| | guanidine | 200 gr | $C_{12}H_{37}(OCH_2CH_2)_8OH$ | 60 | " | 20 | 20 | " |
| | pentaerythritol | 90 gr | | | | | | |
| 9 | $(NH_4PO_3)_6$ | 310 gr | | | | | | |
| | guanidine | 200 gr | $C_{18}H_{37}(OCH_2CH_2)_8OH$ | 60 | " | 20 | 20 | " |
| | pentaerythritol | 90 gr | | | | | | |
| | chlorinated rubber | 3.5 gr | | | | | | |
| 10 | $(NH_4PO_3)_6$ | 310 gr | | | | | | |
| | guanidine | 200 gr | $C_{12}H_{25}(OCH_2CH_2)_8OH$ | 60 | " | 20 | 20 | " |
| | pentaerythritol | 90 gr | | | | | | |
| | chlorinated rubber | 3.5 gr | | | | | | |

What is claimed is:

1. A method for manufacturing suede-like sheet material starting from a raw material consisting of a sheet material of predetermined thickness having a resin layer and a fibrous layer, said fibrous layer comprising a porous polyurethane matrix having a fibrous reinforcement embedded therein, said reinforcement being formed by a material selected from the group consisting of non-woven fabric, polyester fibers, polyamide fibers and polyethylene fibers, and said resin layer being a covering layer of compact polyurethane resin formed securely on one face of said fibrous layer, the method comprising the steps of:

splitting said sheet material through the fibrous layer into two sheets of reduced thickness, the first sheet of which comprises said covering resin layer and a portion of said fibrous layer, and the second sheet which is formed solely of a second portion of said fibrous layer;

said splitting operation being carried out so as to cut said fibrous reinforcement and divide it between said first and second portions of the fibrous layer; and subjecting said second sheet to a buffing operation of a type normally used on natural suede, and to a dyeing phase.

2. A process according to claim 1, wherein is executed said dyeing operation is executed comprises forming the said second sheet into a loop and introducing it into a textile dyeing machine of the jet or flow type.

3. A process according to claim 1, wherein said second sheet, after the dyeing operation and while it is still wet, is subjected to a folding operation entirely identical to that commonly performed on textiles, and is subsequently dried with air.

4. A process according to claim 3, wherein said second sheet, before drying, is subjected to a fireproofing phase which consists of treating it first with an aqueous solution of from 24 to 60% by weight of a mixture of fireproofing substances based on ammonium phosphate, guanidine, or guanidine and pentaerythritol, and subsequently with an aqueous solution of from 8 to 20% by weight of a softening substance containing compounds having linear hydrocarbon chains of from 12 to 18 carbon atoms coupled to radicals of the type $—SO_3X$, where X is an alkaline metal or $—(OCH_2CH_2)_yOH$ and where y is an integer between 1 and 18.

5. A process according to claim 3, wherein said second sheet, before drying, is subjected to a waterproofing phase by immersion in a polyfluoride solution.

6. A process according to claim 4 wherein the said second sheet is subjected to a brushing or dry fulling phase of the same type as that used on natural chamois pelts.

7. A process according to claim 6, wherein said second sheet, after dry brushing, is stamped under pressure at a temperature of at least 90° C. after having arranged a felt beneath the said second sheet.

8. A process according to claim 7, wherein said second sheet, when stamped, is again buffed in such a way as to buff the parts in relief of the previously stamped design.

9. A process according to claim 1, wherein said dyeing phase the said second sheet is first treated with an ammoniacal azo dye, in such a way as to dye the said matrix, and subsequently with at least one pre-metallized or metal complex dye specific to the fibers contained in the said matrix.

10. A process according to claim 1, wherein said dyeing phase said second sheet is treated directly with a mixture of 5% by weight of the weight of raw material to be treated of pre-metallized dyes and with about 1% ammonium sulphate, in an aqueous solution and at a temperature progressively increasing from 30° to about 110° C.

11. A process according to claim 12, wherein in said dyeing phase said second sheet is treated first with an aqueous solution containing at least 30% by weight of the weight of material to be treated of organic or inorganic pigments, wherein the temperature of the solution is raised from 30° to 80° C. in about 60 minutes after which said pigments are precipitated by acidifying with acetic acid up to a pH of about 3.5, and subsequently, the pigment treated sheet is treated with a dye solution containing from 0.1 to 4% of a pre-metallized dye and at least about 10% of a fixative composed of aryl-aliphatic compounds of quaternary ammonium.

* * * * *

UNITED STATES PATENT AND TRADEMARK OFFICE

CERTIFICATE OF CORRECTION

PATENT NO. : 4,941,886

DATED : July 17, 1990

INVENTOR(S) : Poletto

It is certified that error appears in the above-identified patent and that said Letters Patent is hereby corrected as shown below:

Title Page, left column;
Amend Assignee to read:
--(73) LORICA S.P.A., San Mauro Torinese, Italy--

Signed and Sealed this

Twenty-ninth Day of September, 1992

*Attest:*

DOUGLAS B. COMER

*Attesting Officer*

*Acting Commissioner of Patents and Trademarks*

UNITED STATES PATENT AND TRADEMARK OFFICE

CERTIFICATE OF CORRECTION

PATENT NO. : 4,941,886

DATED : July 17, 1990

INVENTOR(S) : Giorgio Poletto

It is certified that error appears in the above-identified patent and that said Letters Patent is hereby corrected as shown below:

Title page, item [73] should read --Lorica S.P.A., Milano, Italy--.

This certificate supersedes Certificate of Correction issued September, 29, 1992.

Signed and Sealed this

Eighth Day of December, 1992

*Attest:*

DOUGLAS B. COMER

*Attesting Officer*

*Acting Commissioner of Patents and Trademarks*